US005209789A

United States Patent [19]

Yoneyama et al.

[11] Patent Number: 5,209,789

[45] Date of Patent: May 11, 1993

[54] PERMANENT MAGNET MATERIAL AND METHOD FOR MAKING

[75] Inventors: Tetsuhito Yoneyama, Chiba; Hideki Nakamura, Narita; Akira Fukuno, Chiba, all of Japan

[73] Assignee: TDK Corporation, Tokyo, Japan

[21] Appl. No.: 755,188

[22] Filed: Sep. 5, 1991

[30] Foreign Application Priority Data

Aug. 29, 1991 [JP] Japan ..... 3-244476

[51] Int. Cl.[5] ..... H01F 1/053

[52] U.S. Cl. ..... 148/302; 428/611; 428/928

[58] Field of Search ..... 148/302; 420/83, 121; 428/611, 928; 164/463

[56] References Cited

U.S. PATENT DOCUMENTS 4,834,811 5/1989 Keem et al. ..... 148/101
4,867,785 9/1989 Keem et al. ..... 148/403

FOREIGN PATENT DOCUMENTS 2-19407 1/1990 Japan .
2-71505 3/1990 Japan .

OTHER PUBLICATIONS

Ohiraki et al, "Study of Rapidly Quenched Crystallized Rare Earth Ribbons with High Energy Products", 1990, pp. 15-21.

Carr et al., "Crystallite Size Determinations for Melt-s-pun Fe-Nd-B Permanent Magnet Alloys", *Materials Science and Engineering*, 1988, pp. 147-151.

*Primary Examiner*—John P. Sheehan

*Attorney, Agent, or Firm*—Oblon, Spivak, McClelland, Maier & Neustadt

[57] ABSTRACT

A melt of Nd-Fe-B alloy is injected in an inert gas atmosphere through a nozzle against a chill roll or a pair of chill rolls rotating relative to the nozzle for contacting the melt with the circumference of the chill roll or rolls, thereby quenching the melt. The chill roll has a low heat conductivity surface layer around a base or has a predetermined surface roughness on its circumference. The contact time of the melt with the chill roll can be increased by blowing an inert gas flow. Further the melt is quenched in an inert gas atmosphere of up to 1 Torr. A wind shield is disposed in proximity to the chill roll circumference for preventing a wind of the ambient gas induced by rotation of the chill roll from reaching a paddle of the melt. With these means, there is obtained a permanent magnet material having a grain diameter with a reduced variation.

16 Claims, 5 Drawing Sheets

PERMANENT MAGNET MATERIAL AND METHOD FOR MAKING

BACKGROUND OF THE INVENTION

1. Field of the Invention

This invention relates to a method for preparing a permanent magnet material of Fe-(Co)-R-B system comprising R which is a rare earth element inclusive of Y throughout the disclosure, Fe, B, and optionally, Co.

2. Prior Art

Typical of high performance rare earth magnets are powder metallurgical Sm-Co base magnets having an energy product of the order of 32 MGOe which have been commercially produced in a mass scale. These magnets, however, undesirably use expensive raw materials Sm and Co. Among the rare earth elements, those elements having a relatively low atomic weight, for example, cerium, praseodymium and neodymium are available in plenty and less expensive compared to samarium. Further Fe is less expensive than Co. Thus R-Fe-B system magnets such as Nd-Fe-B magnets were recently developed as seen from Japanese Patent Application Kokai No. 9852/1985 disclosing rapidly quenched ones.

The rapid quenching process is to inject a metal melt against a surface of a quenching medium for quenching the melt, thereby obtaining the metal in a thin ribbon, thin fragment or powder form. The process is classified into a single roll, twin roll, and disk process depending on the type of quenching medium. Among these rapid quenching processes, the single roll process uses a single chill roll as the quenching medium. An alloy melt is injected through a nozzle against the circumference of the chill roll rotating relative to the nozzle for contacting the melt with the chill roll circumference, thereby quenching the melt from one direction for obtaining a quenched alloy typically in ribbon form. The quenching rate of the alloy is generally controlled by the circumferential speed of the chill roll. The single roll process is widely used because of a reduced number of mechanically controlled components, stable operation, economy, and ease of maintenance The twin roll process uses a pair of chill rolls between which an alloy melt is interposed for quenching the melt from two opposite directions.

The single roll process results in a quenched alloy in which because the rate of cooling on one surface in contact with the chill roll circumference (to be referred to as roll surface, hereinafter) is higher than the rate of cooling on another surface opposite to the roll surface (to be referred to as free surface, hereinafter) during quenching, the grain diameter near the free surface is larger than the grain diameter near the roll surface by a factor of more than 10, for example.

The twin roll process results in a quenched alloy which does not have a free surface, but has a larger grain diameter near the center of the alloy in a thickness direction since the cooling rate intermediate the opposite roll surfaces is slow.

The thus quenched alloys include a very narrow region having optimum grain diameter and will exhibit high magnetic properties with difficulty.

For this reason, the quenched alloy is ground into a magnet powder including both a fraction of magnet particles having high magnetic properties and a fraction of magnet particles having low magnetic properties. When such magnet powder is dispersed in a resin binder to form bonded magnets, these bonded magnets do not exhibit high magnetic properties as a whole, but have locally varying magnetic properties.

SUMMARY OF THE INVENTION

An object of the present invention is to provide a permanent magnet material which is prepared by the single or twin roll process and has minimized the variation of magnetic properties in a cooling direction, thus exhibiting improved magnetic properties as well as a method for preparing the same.

This and other objects are attained by the present invention which is defined below as (1) to (53).

(1) A permanent magnet material prepared by melting an alloy composition comprising R which is at least one rare earth element including Y, Fe or Fe and Co, and B, and contacting the melt with at least one chill roll on its surface, thereby quenching the melt from one direction or two opposite directions, wherein the permanent magnet material has a surface in contact with said at least one chill roll, a region D disposed remotest from the surface in contact with said chill roll in a thickness direction, and a region P disposed adjacent the surface in contact with said chill roll, and said region D has an average grain diameter d and said region P has an average grain diameter p wherein $d/p \leqq 10$.

(2) The permanent magnet material of (1) wherein $1 \leqq d/p \leqq 4$.

(3) The permanent magnet material of (1) or (2) wherein said d ranges from 0.01 to 2 μm and said p ranges from 0.005 to 1 μm.

(4) The permanent magnet material of any one of (1) to (3) wherein the melt is quenched from one direction, and the permanent magnet material has a thickness of up to 60 μm in a direction normal to the surface in contact with said chill roll.

(5) The permanent magnet material of any one of (1) to (3) wherein the melt is quenched from two opposite directions, and the permanent magnet material has a thickness of up to 120 μm in a direction normal to the surface in contact with said chill roll.

(6) The permanent magnet material of any one of (1) to (5) wherein said region disposed adjacent the surface in contact with said chill roll contains an element of which said chill roll at its surface is comprised.

(7) The permanent magnet material of (6) wherein said element is at least one member selected from the group consisting of Co, Ni, Cr, V, and Nb.

(8) The permanent magnet material of any one of (1) to (7) wherein the melt is quenched from one direction, and said region D has a higher content of inert gas than said region P.

(9) The permanent magnet material of any one of (1) to (8) having a composition comprising 5 to 20 atom % of R, 2 to 15 atom % of B, 0 to 55 atom % of Co, and up to 15 atom % of at least one element selected from the group consisting of Zr, Nb, Mo, Hf, Ta, W, Ti, V, and Cr.

(10) A permanent magnet material prepared by melting an alloy composition comprising R which is at least one rare earth element including Y, Fe or Fe and Co, and B, and contacting the melt with at least one chill roll on its surface, thereby quenching the melt from one direction or two opposite directions, wherein the permanent magnet material has a surface in contact with said chill roll, said surface having a centerline average roughness Ra of 0.05 to 4.5 μm.

(11) The permanent magnet material of (10) wherein the melt is quenched from one direction, and the permanent magnet material has a thickness of up to 60 μm in a direction normal to the surface in contact with said chill roll.

(12) The permanent magnet material of (10) wherein the melt is quenched from two opposite directions, and the permanent magnet material has a thickness of up to 120 μm in a direction normal to the surface in contact with said chill roll.

(13) The permanent magnet material of any one of (10) to (12) wherein the surface in contact with said chill roll has a centerline average roughness Ra which is not higher than the centerline average roughness Ra of said chill roll on its surface.

(14) The permanent magnet material of any one of (10) to (13) wherein a region disposed adjacent the surface in contact with said chill roll contains an element of which said chill roll at its surface is comprised.

(15) The permanent magnet material of (14) wherein said element is at least one member selected from the group consisting of Co, Ni, Cr, V, and Nb.

(16) The permanent magnet material of any one of (10) to (15) which includes a region D disposed remotest from the surface in contact with said at least one chill roll in a thickness direction and a region P disposed adjacent the surface in contact with said chill roll, wherein said region D has an average grain diameter d and said region P has an average grain diameter p wherein $d/p \leqq 10$.

(17) The permanent magnet material of (16) wherein $1 \leqq d/p \leqq 4$.

(18) The permanent magnet material of (16) or (17) wherein said d ranges from 0.01 to 2 μm and said p ranges from 0.005 to 1 μm.

(19) The permanent magnet material of any one of (10) to (18) wherein the melt is quenched from one direction, and said region D has a higher content of inert gas than said region P.

(20) The permanent magnet material of any one of (10) to (19) having a composition comprising 5 to 20 atom % of R, 2 to 15 atom % of B, 0 to 55 atom % of Co, and up to 15 atom % of at least one element selected from the group consisting of Zr, Nb, Mo, Hf, Ta, W, Ti, V, and Cr.

(21) A method for preparing a permanent magnet material comprising the steps of melting an alloy composition comprising R which is at least one rare earth element including Y, Fe or Fe and Co, and B, and injecting the melt through a nozzle against at least one chill roll rotating relative to said nozzle for contacting the melt with the circumference of the chill roll, thereby quenching the melt from one direction or two opposite directions, wherein said chill roll includes a base and a surface layer around the base, said surface layer has a lower heat conductivity than said base and a thickness of 10 to 100 μm.

(22) A method for preparing a permanent magnet material according to (21) wherein said surface layer has a thickness of 20 to 50 μm.

(23) A method for preparing a permanent magnet material according to (21) or (22) wherein said chill roll surface layer is formed of a material having a heat conductivity of up to 0.6 J/(cm-s-K).

(24) A method for preparing a permanent magnet material according to (23) wherein said chill roll surface layer is formed of a metal or alloy comprising at least one element selected from the group consisting of Cr, Ni, Co, Nb, and V.

(25) A method for preparing a permanent magnet material according to any one of (21) to (24) wherein said chill roll base is formed of a material having a heat conductivity of at least 1.4 J/(cm-s-K).

(26) A method for preparing a permanent magnet material according to (25) wherein said chill roll base is formed of copper or copper alloy.

(27) A method for preparing a permanent magnet material according to any one of (21) to (26) wherein said chill roll on its circumference has a centerline average roughness Ra of 0.07 to 5 μm.

(28) A method for preparing a permanent magnet material according to any one of (21) to (27) wherein the melt is quenched from one direction, said method further includes the step of blowing an inert gas flow toward the circumference of said chill roll, thereby increasing the contact time of the melt present near the chill roll circumference with the chill roll circumference.

(29) A method for preparing a permanent magnet material according to (28) wherein the inert gas flow is blown through an injector having a slit-shaped orifice for injecting the inert gas, said injector is rotatable or movable to provide a variable position of contact of the inert gas flow at its end nearer to said nozzle with the melt.

(30) A method for preparing a permanent magnet material according to any one of (21) to (29) which further includes the step of providing an inert gas atmosphere having a pressure of up to 1 Torr in proximity to the chill roll circumference where the melt impinges against the chill roll while the melt is quenched.

(31) A method for preparing a permanent magnet material according to any one of (21) to (30) wherein the melt is quenched from one direction through contact with the chill roll circumference, said method further includes the step of providing a wind shield in proximity to the chill roll circumference for preventing a wind of the ambient gas induced by rotation of said chill roll from reaching a paddle of the melt.

(32) A method for preparing a permanent magnet material according to (31) wherein said wind shield is spaced a distance of up to 5 mm from the chill roll circumference during rotation of said chill roll.

(33) A method for preparing a permanent magnet material according to (31) or (32) wherein said wind shield is provided for preventing the induced gas wind from reaching said nozzle.

(34) A method for preparing a permanent magnet material according to any one of (31) to (33) further including the step of providing suction means between said wind shield and the paddle and in proximity to said chill roll circumference for establishing a vacuum near the paddle.

(35) A method for preparing a permanent magnet material comprising the steps of melting an alloy composition comprising R which is at least one rare earth element including Y, Fe or Fe and Co, and B, and injecting the melt through a nozzle against at least one chill roll rotating relative to said nozzle for contacting the melt with the circumference of the chill roll, thereby quenching the melt from one direction or two opposite directions, wherein said chill roll on its circumference has a centerline average roughness Ra of 0.07 to 5 μm.

(36) A method for preparing a permanent magnet material according to (35) wherein the melt is quenched from one direction, said method further includes the step of blowing an inert gas flow toward the circumference of said chill roll, thereby increasing the contact time of the melt present near the chill roll circumference with the chill roll circumference.

(37) A method for preparing a permanent magnet material according to (35) or (36) wherein the inert gas flow is blown through an injector having a slit-shaped orifice for injecting the inert gas, said injector is rotatable or movable to provide a variable position of contact of the inert gas flow at its end nearer to said nozzle with the melt.

(38) A method for preparing a permanent magnet material according to any one of (35) to (37) which further includes the step of providing an inert gas atmosphere having a pressure of up to 1 Torr in proximity to the chill roll circumference where the melt impinges against the chill roll while the melt is quenched.

(39) A method for preparing a permanent magnet material according to any one of (35) to (37) wherein the melt is quenched from one direction through contact with the chill roll circumference, said method further includes the step of providing a wind shield in proximity to the chill roll circumference for preventing a wind of the ambient gas induced by rotation of said chill roll from reaching a paddle of the melt.

(40) A method for preparing a permanent magnet material according to (39) wherein said wind shield is spaced a distance of up to 5 mm from the chill roll circumference during rotation of said chill roll.

(41) A method for preparing a permanent magnet material according to (39) or (40) wherein said wind shield is provided for preventing the induced gas wind from reaching said nozzle.

(42) A method for preparing a permanent magnet material according to any one of (39) to (41) further including the step of providing suction means between said wind shield and the paddle and in proximity to said chill roll circumference for establishing a vacuum near the paddle.

(43) A method for preparing a permanent magnet material comprising the steps of melting an alloy composition comprising R which is at least one rare earth element including Y, Fe or Fe and Co, and B, injecting the melt through a nozzle against a chill roll rotating relative to said nozzle for contacting the melt with the circumference of the chill roll, thereby quenching the melt from one direction, and blowing an inert gas flow toward the circumference of said chill roll, thereby increasing the contact time of the melt present near the chill roll circumference with the chill roll circumference.

(44) A method for preparing a permanent magnet material according to (43) wherein the inert gas flow is blown through an injector having a slit-shaped orifice for injecting the inert gas, said injector is rotatable or movable to provide a variable position of contact of the inert gas flow at its end nearer to said nozzle with the melt.

(45) A method for preparing a permanent magnet material according to (43) or (44) which further includes the step of providing an inert gas atmosphere of up to 1 Torr in proximity to the chill roll circumference where the melt impinges against the chill roll while the melt is quenched.

(46) A method for preparing a permanent magnet material according to (43) or (44) which further includes the step of providing a wind shield in proximity to the chill roll circumference for preventing a wind of the ambient gas induced by rotation of said chill roll from reaching a paddle of the melt.

(47) A method for preparing a permanent magnet material according to (46) wherein said wind shield is spaced a distance of up to 5 mm from the chill roll circumference during rotation of said chill roll.

(48) A method for preparing a permanent magnet material according to (46) or (47) wherein said wind shield is provided for preventing the gas wind from reaching said nozzle.

(49) A method for preparing a permanent magnet material according to any one of (46) to (48) further including the step of providing suction means between said wind shield and the paddle and in proximity to said chill roll circumference for establishing a vacuum near the paddle.

(50) A method for preparing a permanent magnet material comprising the steps of melting an alloy composition comprising R which is at least one rare earth element including Y, Fe or Fe and Co, and B, injecting the melt through a nozzle against a chill roll rotating relative to said nozzle for contacting the melt with the circumference of the chill roll, thereby quenching the melt from one direction, and providing a wind shield in proximity to the chill roll circumference for preventing a wind of the ambient gas induced by rotation of said chill roll from reaching a paddle of the melt.

(51) A method for preparing a permanent magnet material according to (50) wherein said wind shield is spaced a distance of up to 5 mm from the chill roll circumference during rotation of said chill roll.

(52) A method for preparing a permanent magnet material according to (50) or (51) wherein said wind shield is provided for preventing the gas wind from reaching said nozzle.

(53) A method for preparing a permanent magnet material according to any one of (50) to (52) further including the step of providing suction means between said wind shield and the paddle and in proximity to said chill roll circumference for establishing a vacuum near the paddle.

Conventional chill rolls used in the rapid quenching process are formed of a material which is selected for a particular purpose from various metals and alloys such as copper, copper-beryllium alloy, stainless steel, and tool steel by taking into account wettability with alloy melt, heat conductivity, heat capacity, wear resistance, and other factors. Chill rolls of a single material had the following problems.

Although copper base materials have enough high heat conductivity, typically a heat conductivity of 3.85 J/(cm-s-K) for copper, to achieve a high cooling rate, the resulting metal ribbon experiences a difference in cooling rate between the roll and free surfaces because of too fast heat transfer. Another drawback of copper base materials is low resistance to wear.

Iron base materials, for instance, are free of the problems associated with the copper base materials, but achieve an insufficient cooling rate to provide a magnetic metal of desired structure due to their low heat conductivity as exemplified by a heat conductivity of 0.245 J/(cm-s-K) for stainless steel. In addition, if alloy melt is continuously subject to rapid quenching using a chill roll of low heat conductivity material, there occurs insufficient heat transfer to the chill roll core so that the chill roll near its circumference experiences a noticeable temperature rise. As a result, the cooling rate is gradually lowered, failing to obtain magnetic metal of good magnetic properties or inviting a variation in properties within a lot.

According to the present invention, the chill roll is provided with a surface layer which has a lower heat conductivity than the heat conductivity of the roll base and preferably, a thickness selected in the optimum range. This eliminates the drawback of a conventional chill roll consisting solely of a certain material and reduces the difference in cooling rate between the roll and free surfaces, thus restraining the ratio of grain diameter therebetween to 10 or less.

Also, the chill roll used in the practice of the present invention preferably has a centerline average roughness Ra within the above-defined range at its circumference to be in contact with the alloy melt.

In general, the rate of cooling of alloy increases as the circumferential speed of a chill roll increases. This is because the increased circumferential speed leads to an increased area of the chill roll circumference available per unit time. In the case of a chill roll having the above-defined Ra on its circumference, however, an alloy melt in contact with the chill roll circumference can make close contact with raised portions of the circumference, but less contact with recessed portions of the circumference, and the contact with recessed portions is further reduced with an increasing circumferential speed. Therefore, a higher circumferential speed provides a smaller contact area of alloy melt with the chill roll circumference and a lower cooling rate therewith.

Accordingly, if a chill roll having the above-defined Ra on its circumference is increased in circumferential speed, then an increase in cooling rate due to an increased area of the chill roll circumference available is offset by a lowering of cooling rate due to the above-defined Ra of the chill roll circumference, resulting in the alloy cooling rate left substantially unchanged. Therefore, there is obtained a permanent magnet material in which the grain diameter remains substantially unchanged despite a variation in the circumferential speed of a chill roll, that is, the dependency of magnetic properties on circumferential speed is very low.

It is thus unnecessary to strictly control the circumferential speed of a chill roll with the benefits of an increased effective life of the associated apparatus and possible mass production at low cost.

Since a substantially constant cooling rate is available over a wide range of circumferential speed, the thickness of permanent magnet material can be freely changed by changing the circumferential speed while maintaining optimum cooling rate.

As the thickness of permanent magnet material is reduced, a chill roll having the above-mentioned surface layer becomes more effective because the difference in grain diameter between the roll and free surfaces is reduced.

It will be understood that thin forms of permanent magnet material can be obtained by reducing the diameter of an alloy melt injection nozzle. Since R-Fe-B system alloys are rather reactive with the injection nozzle, continuous injection of alloy melt through a narrow nozzle would often invite nozzle clogging It is efficient in mass productivity to manufacture thin alloy ribbons by increasing the circumferential speed of a chill roll because no nozzle clogging occurs.

Using a chill roll having the above-defined Ra on its circumference, there is obtained a permanent magnet material which on the roll surface generally has a Ra value lower than the Ra of the chill roll circumference. This is because a higher circumferential speed provides a smaller contact area of alloy with the chill roll circumference as previously mentioned.

Further in the practice of the present invention, it is preferred to effect quenching of alloy melt in an inert gas atmosphere of up to 1 Torr.

Since R-Fe-B system alloys are quite prone to oxidation, their rapid quenching is generally effected in an inert gas atmosphere. In the single and twin roll processes, inert gas in the proximity to the chill roll circumference is entrained between the alloy melt and the chill roll circumference by rotation of the chill roll. Such entrainment of inert gas disturbs the contact of alloy with the chill roll circumference, resulting in a lowering of alloy cooling rate and an enlargement of grains in the entrained areas.

As a result, the grain diameter becomes nonuniform on the roll surface, and the free surface is also affected thereby, resulting in an increased grain diameter.

The use of an atmosphere of up to 1 Torr for quenching avoids entrainment of inert gas between the melt and the chill roll circumference, improves the contact between the melt and the chill roll circumference, and eliminates local variation in cooling rate on the roll surface, resulting in a permanent magnet of fine uniform grain structure having high magnetic properties.

When the present invention is applied to the single roll process, preferably an inert gas flow is blown toward the chill roll circumference to bias the melt present near the chill roll circumference against the chill roll, thereby increasing the contact time of the melt with the chill roll circumference.

In the single roll process, the alloy melt is impinged against the circumference of a rotating chill roll, cooled in a thin ribbon form while it is dragged by the chill roll circumference, and then separated from the chill roll circumference.

In such single roll process, the fully prolonged contact of the melt with the chill roll circumference ensures that both the roll and free surfaces be cooled relatively uniformly due to heat transfer to the chill roll. Differently stated, the melt must be in full contact with the chill roll circumference when the melt is substantially solidified on the roll surface side, but molten on the free surface side before a quenched alloy having uniform grain diameter can be obtained.

However, since a melt of R-Fe-B system alloy is separated from the chill roll circumference immediately after impingement against the chill roll circumference, the melt is cooled on the roll surface side mainly through heat transfer to the chill roll, but on the free surface side mainly through heat release into the ambient atmosphere, resulting in a significant difference in cooling rate between the roll and free surface sides.

Thus, by increasing the contact time of the melt with the chill roll circumference by inert gas blowing as defined above, the free surface side cooling becomes more dependent on heat transfer to the chill roll, resulting in a substantially reduced difference in cooling rate between the roll and free surface sides. The blowing of inert gas against the free surface results in a further increased cooling rate on the free surface side.

This results in a further reduced difference in cooling rate between the roll and free surface sides. Improved cooling efficiency allows the necessary rotational speed of the chill roll to be reduced, for example, by about 5 to 15%, thus reducing the load of quenching apparatus.

Moreover, in the single roll process, it is preferred, as shown in FIG. 3, to provide a wind shield 2 in front of a nozzle 12 for preventing a wind of the ambient gas from reaching a paddle 113 of the melt 11 (a mass of alloy melt extending between the tip of nozzle 12 and the circumference of chill roll 13). This arrangement avoids entrainment of inert gas between the melt and the chill roll circumference, improves the contact between the melt and the chill roll circumference, reduces local variation in cooling rate on the roll surface, and reduces variation in grain diameter on the free surface side, resulting in a permanent magnet of fine uniform grain structure having high magnetic properties.

Entrainment of inert gas can be further reduced by providing suction means 200 between the nozzle 12 and the wind shield 2 for establishing a local vacuum in proximity to the paddle 113.

DESCRIPTION OF THE PREFERRED EMBODIMENTS

Figure 1:
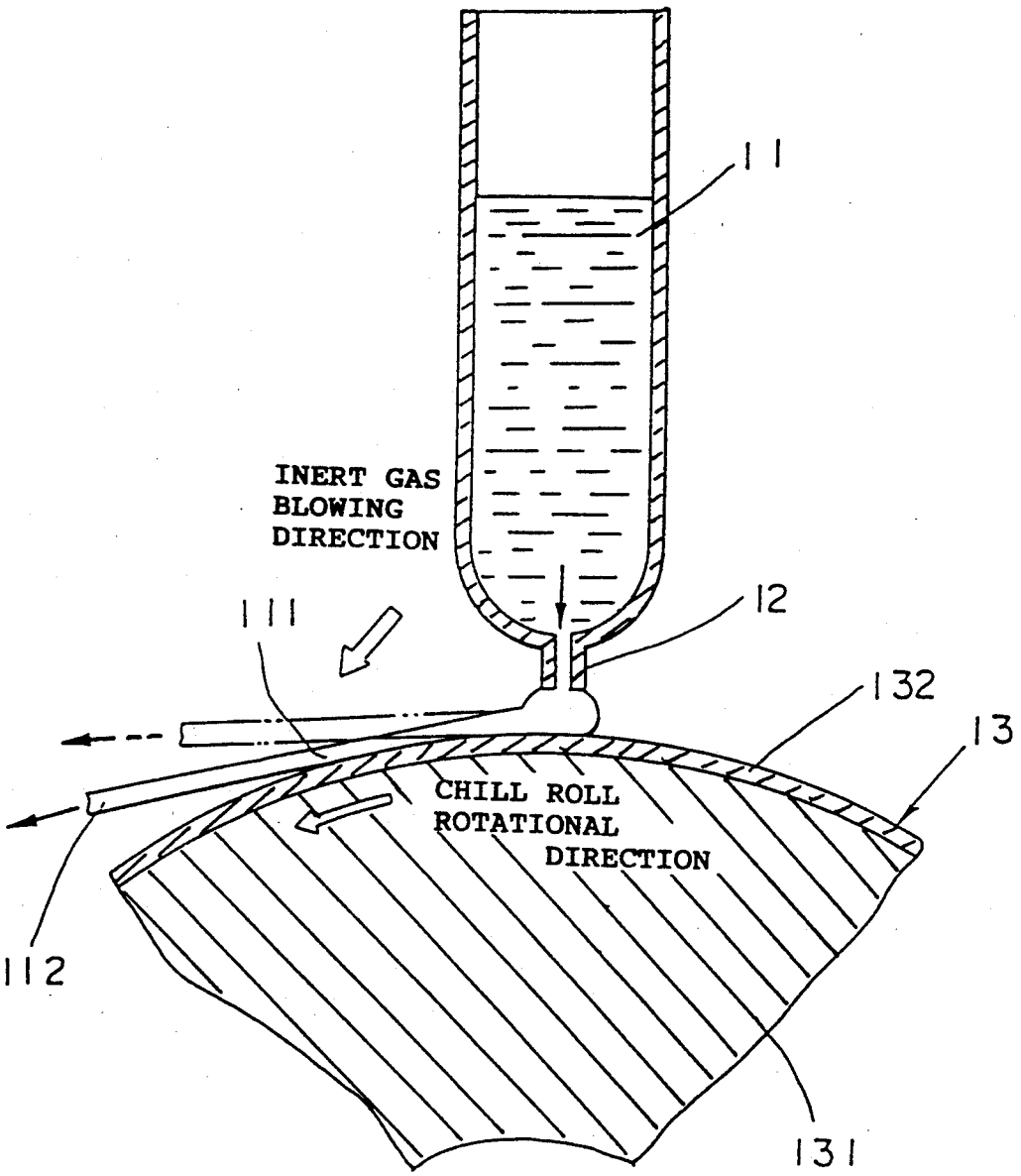
FIG. 1 is a schematic view of one preferred embodiment of the present invention.

The illustrative construction of the present invention will be described in detail.

According to the present invention, a permanent magnet material is prepared by melting an alloy composition comprising R which is at least one rare earth element including Y, Fe or Fe and Co, and B, and injecting the melt through a nozzle for contacting the melt with the circumference of a chill roll rotating relative to the nozzle, thereby quenching the melt from one direction or two opposite directions.

That is, the present invention preferably employs a single or twin roll process for the quenching of an alloy melt.

In the practice of the invention, it is preferred to use a chill roll comprising a base and a surface layer on the circumference of the base which has a lower heat conductivity than the heat conductivity of the roll base.

Preferably in the practice of the invention, the surface layer has a heat conductivity of up to 0.6 J/(cm-s-K), especially up to 0.45 J/(cm-s-K). With a higher heat conductivity above the range, the invention would become less effective because the surface layer cannot quickly assume a constant temperature after the start of quenching. Although no particular lower limit is imposed on the heat conductivity of the surface layer, a heat conductivity of lower than 0.1 J/(cm-s-K) would discourage heat transfer, allowing the surface layer to have high temperature only in proximity to its surface and sometimes causing seizure. It is to be noted that the heat conductivity used herein refers to that at room temperature and atmospheric pressure.

In view of the durability of a chill roll, the surface layer is preferably formed of a material having a high melting temperature and wear resistance. The preferred materials of which the surface layer is formed include Cr, Ni, Co, Nb, V and a similar element alone, an alloy containing at least one element thereof, and stainless steel, quenched steel and the like. The alloy should preferably contain at least 20% by weight of any one of the above-mentioned elements.

In the practice of the invention, the surface layer preferably has a thickness of 10 to 100 μm, especially 20 to 50 μm. A surface layer having a thickness within this range allows for quick heat transfer to the roll base, eventually promoting precipitation of a grain boundary phase consisting essentially of a R-poor phase which in turn, results in high Br. This benefit would be lost with a surface layer thickness outside the above-defined range. A particular thickness may be decided for the surface layer within the above-defined range by considering various parameters including the method of forming the surface layer, heat conductivity of surface layer material, chill roll dimensions, and the speed of the chill roll relative to the alloy melt.

It is not critical how to form the surface layer, and any desired technique may be chosen, for example, liquid phase plating, gas phase plating, spraying, thin plate bonding, and cylindrical member shrinkage fit. After the surface layer is formed, the surface thereof may be polished if desired.

It is to be appreciated that the resulting permanent magnet material in proximity to the roll surface may contain an element of which the chill roll surface layer is comprised. The chill roll surface layer-forming element or elements which are contained in the permanent magnet material are those elements which have been diffused from the chill roll circumference during rapid quenching. The surface layer-forming element or elements are contained in amounts of about 10 to 500 ppm in a region extending up to 20 nm from the roll surface in a thickness direction.

The chill roll base may be formed of any desired material insofar as it meets the heat conductivity requirement mentioned above, for example, copper, copper alloys, silver and silver alloys. Aluminum and aluminum alloys are also useful for rapid quenching of low-melting alloys although copper and copper alloys are preferred for high heat conductivity and low cost. Copper-berylliun alloy is a preferred copper alloy.

Preferably, the roll base has a heat conductivity of at least 1.4 J/(cm-s-K), more preferably at least 2 J/(cm-s-K), most preferably at least 2.5 J/(cm-s-K).

In the practice of the invention, preferred combinations of the base-forming material with the surface layer-forming material include copper alloy bases with Ni, Co and Cr surface layers. Among them, the Co and Cr surface layers are more preferred, with the Cr surface layer being most preferred.

Rapid quenching with the above-mentioned chill roll results in a permanent magnet material which has a surface having been in contact with the chill roll during rapid quenching (roll surface), a region D disposed remotest from the roll surface in a thickness direction, and a region P disposed adjacent the roll surface, wherein region D has an average grain diameter d and region P has an average grain diameter p wherein $d/p \leqq 10$, preferably $d/p \leqq 4$, more preferably $d/p \leqq 2.5$. It is to be noted that the lower limit of d/p is generally 1. The use of the above-mentioned chill roll facilitates to achieve a better d/p value within $1.5 \leqq d/p \leqq 2$.

Either a method of rapidly quenching an alloy melt from one direction or a method of rapidly quenching an alloy melt from two opposite directions may be used in the practice of the invention. Depending on whether the melt is rapidly quenched from one or two directions, the location of region D within which an average grain diameter is calculated differs.

First, reference is made to the single roll process which is a preferred exemplary method of rapidly quenching an alloy melt from one direction. In accordance with the rapid quenching method used in the present invention, permanent magnet material is generally available in thin ribbon form, thin fragment form or powder form consisting of flat particles. The permanent magnet material in such form has a roll surface and a surface opposed thereto (free surface) as major surfaces. The term "thickness direction" of permanent magnet material used herein refers to a direction normal to the major surface.

In the case of the single roll process, the above-defined region D is a region disposed adjacent the free surface and region P is a region disposed adjacent the roll surface. Each of regions D and P has a width in the magnet thickness direction which is equal to 1/5 of the magnet thickness.

It will be understood that in addition to the single roll process, an alloy melt can be rapidly quenched from one direction by a method of atomizing an alloy melt for impinging the atomized melt against a cooling base of suitable shape, typically disk shape. The present invention is also applicable to such a method. To atomize the metal melt, a gas atomizing technique using an inert gas or any suitable gas is preferably chosen. One preferred method is the one described in Japanese Patent Application Kokai No. 7011/1990. In this method, regions D and P are determined in the same manner as in the single roll process.

Reference is now made to the twin roll process which is a preferred exemplary method of rapidly quenching an alloy melt from two opposite directions. In the case of twin roll process, region D is a central region disposed between the opposed major surfaces and region P is a region disposed adjacent the roll surface. Each of regions D and P has a width in the magnet thickness direction which is equal to 1/5 of the magnet thickness.

Measurement of average grain diameter in these regions is preferably carried out using a scanning electron microscope. Preferably, average grain diameter d in region D ranges from 0.01 to 2 μm, especially from 0.01 to 1.0 μm and average grain diameter p in region P ranges from 0.005 to 1 μm, especially from 0.01 to 0.75 μm. Energy product would be low with an average grain diameter below these ranges whereas coercive force would be low with an average grain diameter above these ranges.

Further preferably, the grain boundary has a width of from 0.001 to 0.1 μm, especially from 0.002 to 0.05 μm in region D and from 0.001 to 0.05 μm, especially from 0.002 to 0.025 μm in region P. Saturation magnetic flux density would be low with a grain boundary width below these ranges whereas coercive force would be low with a grain boundary width above these ranges.

It is to be noted that the permanent magnet material according to the present invention has a thickness of at least 10 μm. Thickness of less than 10 pm means that permanent magnet material has an unnecessarily increased surface area and is thus prone to oxidation during pulverizing prior to the manufacture of bonded magnets and handling.

In the practice of the invention, the chill roll used in either the single or twin roll process preferably has a centerline average roughness Ra of from 0.07 to 5 μm, especially from 0.15 to 4 μm on its circumference in contact with the alloy melt.

With Ra on the chill roll circumference below the range, the close contact of the melt with the chill roll circumference is not mitigated even when the circumferential speed is increased, resulting in the increased dependency of cooling rate on circumferential speed. If Ra of the chill roll is above the range, the surface roughness of the chill roll circumference would be significantly increased relative to the thickness of thin ribbon-shaped permanent magnet material, resulting in a ribbon of uneven thickness. The centerline average roughness Ra is defined by JIS B-0601.

With the use of such a chill roll, there is obtained a permanent magnet material having a Ra value of from 0.05 to 4.5 μm, preferably from 0.13 to 3.7 μm on the roll surface.

In the case of single roll process, the permanent magnet material preferably has a thickness of up to 60 μm. With such a thickness, the difference in average grain diameter between the roll and free surface sides is minimized. The use of a chill roll having the above-defined Ra which ensures a substantially constant cooling rate over a wide range of circumferential speed permits a thin ribbon shaped permanent magnet material to be produced to a thickness of 60 μm or less without reducing the diameter of the melt injection nozzle.

Also, the permanent magnet material preferably has a thickness of up to 120 μm in the case of twin roll process for the same reason as in the single roll process.

In the practice of the invention, an alloy melt is preferably quenched in an inert gas atmosphere of up to 1 Torr. The inert gas used is not particularly limited and may be selected from various inert gases such as Ar, He, and $N_2$ gases, with the Ar gas being preferred.

Use of an inert gas atmosphere of up to 1 Torr in the quenching of a melt prevents entrainment of the ambient gas between the melt and the chill roll circumference.

No particular lower limit is imposed on the atmosphere pressure. When radio frequency induction heating is used for melting the alloy, it is preferred to enhance the insulation of a radio frequency induction heating coil because an electric discharge would otherwise occur between the coil and the chill roll under an atmosphere pressure of lower than $10^{-3}$ Torr, especially lower than $10^{-4}$ Torr.

The permanent magnet material produced in an atmosphere of up to 1 Torr has few recesses caused by entrainment of the ambient gas on the roll surface side and accordingly, a more uniform distribution of grain diameter in proximity to the roll surface. For example, the standard deviation of grain diameter in the roll surface adjoining region can be reduced to 13 nm or less, especially 10 nm or less. The roll surface adjoining region used herein is the same as the above-defined region P which extends from the roll surface to a depth equal to 1/5 of the magnet thickness.

The standard deviation of grain diameter in this region can be calculated by taking pictures under a transmission electron microscope such that more than about 100 grains are contained within the field. After more than 30, preferably more than 50 pictures are randomly took within the region, the average grain diameter in each field is calculated by image analysis or the like. The average grain diameter thus determined is generally an average diameter of circles equivalent to the grains. Finally, the standard deviation of these average grain diameters is determined.

Where the present invention is applied to the single roll process, an inert gas flow is preferably blown toward the chill roll circumference for increasing the contact time of the melt present near the chill roll circumference with the chill roll circumference.

Figure 3:
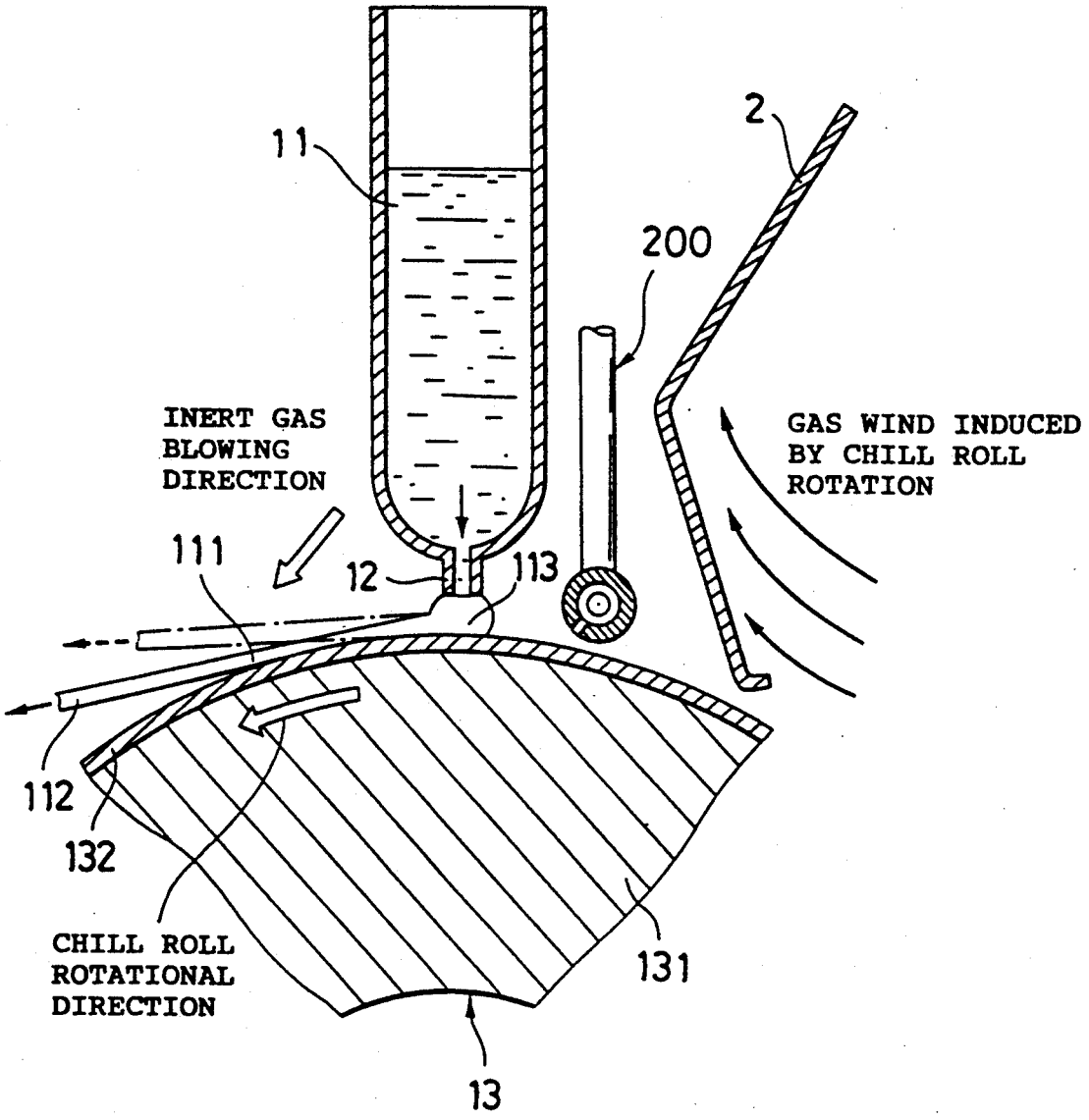
FIG. 3 is a schematic view of one preferred embodiment of the present invention.

FIGS. 1 and 3 schematically illustrate how to blow an inert gas flow. In the single roll process illustrated in FIGS. 1 and 3, an alloy melt 11 is injected through a nozzle 12 against the circumference of a chill roll 13 rotating relative to the nozzle 12 for contacting the melt 111 present near the circumference of the chill roll 13 with the chill roll 13 circumference, thereby cooling the melt 111 from one direction. Understandably, the chill roll 13 is comprised of a base 131 and a surface layer 132 as previously described.

By blowing an inert gas flow toward the circumference of chill roll 13, the contact time of the melt 111 near the chill roll 13 circumference with the chill roll 13 circumference is increased. Unless an inert gas flow is blown, the melt will separate from the chill roll 13 circumference immediately after impingement with the chill roll 13 as depicted by phantom lines in the figures, resulting in a shorter contact time of the melt with the chill roll circumference.

It will be understood that the alloy melt 111 is a solidified or molten mass or a partially solidified and partially molten mass depending on the distance from the nozzle 12 and is most often a thin ribbon containing a larger proportion of solidified alloy on the roll surface side and a larger proportion of molten alloy on the free surface side.

The direction of blowing an inert gas flow is toward the circumference of chill roll 13 such that the melt 111 is sandwiched between the gas flow and the chill roll while no additional limitation is imposed. Preferably, inert gas is blown such that the angle between the blowing inert gas flow and the direction of advance of ribbon shaped permanent magnet material 112 resulting from quenching is obtuse as shown by an arrow in FIGS. 1 and 3. The preferred angle is in the range of about 100° to about 160°. This range of angle is selected for preventing the blowing inert gas from directly reaching a paddle 113 (a mass of alloy melt exiting from the tip of nozzle 12 to the circumference of the chill roll 13), thereby maintaining the paddle 13 in steady state. If inert gas were blown directly to the paddle, the paddle would be locally cooled whereupon viscosity is increased so that the paddle might change its shape, thus failing to obtain an alloy ribbon of uniform thickness. Understandably, the direction of advance of ribbon shaped permanent magnet material 112 substantially coincides with a tangential direction on the chill roll circumference where the melt 111 takes off from the chill roll 13.

Immediately after impingement against the chill roll, the alloy melt is in molten state from its free surface to a substantial depth. If inert gas is blown against the melt in such entirely molten state, not only the free surface would become wavy due to the gas flow, failing to produce an alloy ribbon of uniform thickness, but also heat transfer within the melt is locally accelerated or delayed, resulting in a variation of grain diameter. It should thus be avoided to blow inert gas against the melt immediately after impingement against the chill roll.

More particularly, the inert gas is blown against the melt at a location spaced from the position immediately below the nozzle 12 by a distance of at least 5 times the diameter of nozzle 12.

No benefits are obtained by blowing inert gas at a location far remote from the paddle because the melt on the free surface side is completely solidified at such a far location. Therefore, the location at which inert gas is blown against the melt is preferably limited within a distance of 50 times the diameter of nozzle 12 from the position immediately below nozzle 12. The location at which inert gas is blown against the melt used herein is one end of the inert gas flow nearer to the nozzle 12 rather than the center thereof. In the case of a slit-shaped nozzle, the nozzle diameter used herein is the dimension of a slit as measured in the rotational direction of the chill roll. The inert gas blowing location is determined in relation to the nozzle diameter because the nozzle diameter dictates the paddle state and cooling efficiency which in turn, dictates the molten state of the melt.

No particular limit is imposed on the direction, flow rate, flow velocity, and injection pressure of blowing inert gas flow, which can be determined by taking into account various parameters including nozzle diameter, melt injection rate, chill roll dimensions, and cooling atmosphere, and empirically such that a desired grain diameter may be obtained in the melt between the roll and free surface sides. In an example wherein a melt is injected through a nozzle having a diameter of about 0.3 to 5 mm, inert gas is preferably injected through a slit having a longitudinal direction aligned with the transverse direction of a melt ribbon. The preferred inert gas blowing slit has a breadth of about 0.2 to about 2 mm and a longitudinal dimension of at least 3 times the transverse width of a melt ribbon and is spaced about 0.2 to about 15 mm apart from the chill roll circumference. The preferred injection pressure is from about 1 to about 9 kg/cm$^2$. A smaller spacing between the slit and the roll circumference leaves the possibility of contact of the slit with the melt on the roll surface whereas a larger spacing allows the injected inert gas to diffuse so widely that the desired effect is little achieved and the paddle can be cooled therewith.

No particular limit is imposed on means for blowing inert gas. It is preferred in the practice of the invention to use an injector having an inert gas injecting orifice of slit shape as mentioned above or similar shape. Preferred is an injector which is rotatable or movable for changing the inert gas blowing location That is, the injector is rotatable or movable to provide a variable position of contact with the melt of the inert gas flow at its end nearer to the nozzle.

Figure 2:
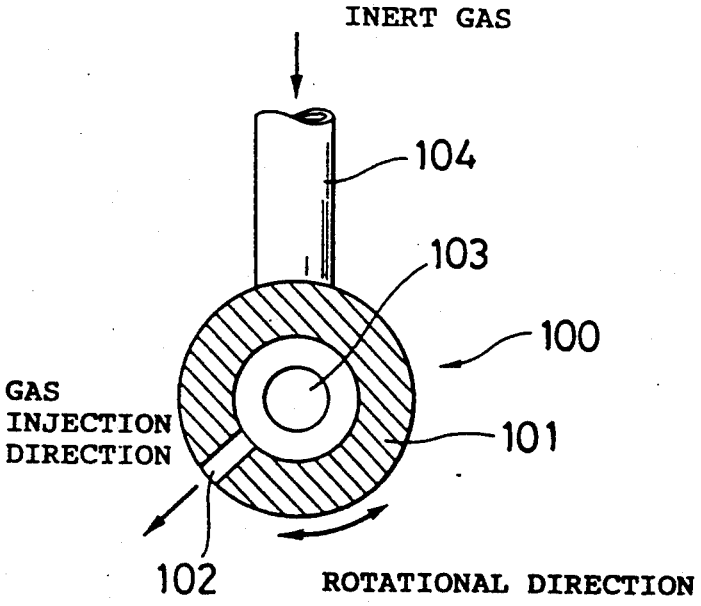
FIG. 2 is a cross sectional view of an exemplary inert gas injector used in the present invention.

More particularly, an injector as shown in FIG. 2 is preferred. The injector 100 shown in FIG. 2 has a cylindrical peripheral wall 101 and a slit-shaped orifice 102 extending throughout the wall 101. The slit-shaped orifice 102 has a longitudinal direction extending substantially parallel to the axis of the injector, i.e., cylindrical peripheral wall 101. One end of the cylindrical peripheral wall 101 (on the front plane of the sheet in the illustrated embodiment) is closed and the other end is connected to a gas inlet tube 104 in flow communication with the injector interior through a hole 103. With this configuration, inert gas is channeled into the injector interior and then injected through the slit-shaped orifice 102 as a directional flow.

The injector 100 is disposed in proximity to the chill roll such that the axis of the injector 100 is substantially parallel to the axis of the chill roll. By rotating the injector 100 about its axis, the direction of blowing inert gas flow can be changed as desired.

Where an alloy melt is quenched in a vacuum of 1 Torr or lower, the quenching step has to take place in a vacuum chamber. In an embodiment wherein inert gas is injected into the vacuum chamber, it suffices to keep an inert gas atmosphere of up to 1 Torr in proximity to the chill roll circumference against which the alloy melt impinges. To this end, the gas is preferably evacuated from the vacuum container to control the pressure in proximity to the chill roll circumference against which the alloy melt impinges to the desired value. In this case, it is preferred to provide a vent port in proximity to the chill roll in addition to a main vent port of the vacuum container whereby the injected gas is discharged out of the vacuum container through the vent port. No particular limit is imposed on the inert gas to be injected, which may be suitably selected from Ar gas, $N_2$ gas, He gas, and the like.

Analysis of the permanent magnet material produced in this embodiment will detect that the inert gas blown during quenching is contained therein richer in proximity to the free surface than in the proximity to the roll surface. Ar or $N_2$ gas, if used as the inert gas, for example, can be readily detected by Auger analysis. The content of inert gas is about 50 to about 500 ppm in a region extending up to 50 nm from the free surface in a thickness direction.

Understandably, the inert gas blown against the alloy melt is preferably of the same type as the ambient gas.

Where the present invention is applied to the single roll process, no particular limit is imposed on the dimensions of a chill roll. The chill roll may have suitable dimensions for a particular purpose although it generally has a diameter of about 150 to about 1500 mm and a breadth of about 20 to about 100 mm. The roll may be provided with a water cooling hole at the center.

Although the circumferential speed of the chill roll varies with various parameters including the composition of roll surface layer, composition of alloy melt, structure of an end permanent magnet material, and optional heat treatment, it preferably ranges from 1 to 50 m/s, especially from 5 to 40 m/s. Circumferential speeds below the range would allow the majority of permanent magnet material to have larger grains whereas circumferential speeds beyond the range would result in almost amorphous material having poor magnetic properties. In the case of single roll process, the permanent magnet material is generally obtained in thin ribbon form.

Where the present invention is applied to the single roll process, the chill roll is generally disposed such that its axis is substantially horizontal. The nozzle may be located on a vertical line passing the chill roll axis as shown in FIG. 1 although the nozzle can be located on a front or rear side of the vertical line with respect to the rotational direction of the chill roll (that is, the right or left side in the figure).

Where the present invention is applied to the twin roll process, no particular limit is imposed on the dimensions of and spacing between chill rolls. The chill rolls generally have a diameter of about 50 to about 300 mm and a breadth of about 20 to about 80 mm and are spaced about 0.02 to about 2 mm from each other. It is acceptable to apply pressure to the chill rolls during melt quenching, thereby achieving simultaneous quenching and rolling. The operating conditions for the twin roll process may be approximate to those for the above-mentioned single roll process although the circumferential speed of chill rolls preferably ranges from 0.3 to 20 m/s. In the case of twin roll process, the permanent magnet material is generally obtained in thin ribbon or fragment form.

FIG. 3 is a schematic view illustrating another embodiment of the present invention. In FIG. 3, a chill roll 13 and a nozzle 12 are in an inert gas atmosphere and the chill roll is rotating in the arrow direction. Due to its viscosity, inert gas in proximity to the chill roll 13 forms a gas wind having a velocity in the rotational direction of the chill roll. An alloy melt 11 is injected through nozzle 12 against chill roll 13 for contacting the chill roll circumference where it is cooled into a ribbon shaped permanent magnet material 112 and flew away in the rotational direction of chill roll 13. A wind shield 2 is provided in proximity to the chill roll circumference on the right side of nozzle 12 as viewed in the figure (or the front side with respect to the rotational direction). The wind shield 2 is effective in shielding at least part of the inert gas wind flowing over the chill roll circumference for preventing the inert gas wind reaching the paddle 113, thereby minimizing the amount of inert gas entrained between the chill roll circumference and the melt as injected.

No particular limit is imposed on the configuration of the wind shield 2 which can shield at least part of the inert gas wind flowing toward the paddle 113. It is preferred to form the wind shield 2 from a plate member which is configured as shown in FIG. 3 because of ease of fabrication and high gas flow shielding effect. The wind shield 2 shown in FIG. 3 includes three plate segments connected at two bends. If the plate-like wind shield 2 is elastic, the plate segment located nearest to the chill roll tends to float upward from the chill roll circumference upon receipt of the gas wind induced by rotation of the chill roll. The floating amount, that is, the distance between the wind shield and the chill roll circumference can be controlled by adjusting the angle relative to the chill roll circumference and the area of the lowest plate segment. However, a rigid wind shield is also acceptable which can keep a fixed distance between the wind shield and the chill roll independent of rotation of the chill roll.

In addition to the wind shield of the construction shown in FIG. 3, a wind shield of the following construction is also useful. For example, a wind shield of the construction shown in FIG. 3 is provided at each transverse end with a side plate which covers at least a part of the side surface of the chill roll, preferably the side surface of the chill roll in proximity to the paddle 113, thereby shielding at least part of the gas flow approaching the paddle from the opposite sides thereof.

Also a wind shield which is longitudinally or transversely bent, for example, a wind shield of U-shaped cross section surrounding the paddle may be used for rectifying the gas flow and preventing entrainment of the gas flow in proximity to the paddle.

The spacing between the wind shield 2 and the chill roll circumference is not particularly limited, but may be suitably determined in accordance with the location of wind shield 2 and the circumferential speed of chill roll 13. Since the gas flow induced by rotation of the chill roll has a velocity distribution that velocity is maximum at the chill roll circumference and drastically lowers in proportion to the distance from the circumference, the spacing is preferably 5 mm or less, especially 3 mm or less during rotation of the chill roll for effectively shielding the gas flow. No lower limit is imposed on the spacing although the spacing should preferably be 0.1 mm or more, especially 0.2 mm or more in order to avoid potential contact of the wind shield with the chill roll circumference during chill roll rotation probably due to circumferential irregularities and eccentricity of the chill roll. The spacing should preferably be constant along the breadth direction of the wind shield although the spacing can be locally varied within the above-mentioned range.

Also, no particular limit is imposed on the breadth of the wind shield (the distance between opposite ends of the wind shield in a transverse direction over the circumference of the chill roll) although the wind shield breadth should preferably be larger than the breadth of the chill roll, especially by about 10%.

No particular limit is imposed on the height of the wind shield. That is, the wind shield can have an adequate height as desired since the pattern of gas flow to be shielded varies with the circumferential speed of the chill roll or the like. Since the nozzle having the molten alloy received therein is also exposed to the gas wind, the wind shield should preferably have a sufficient height for shielding the gas flow from impinging the nozzle, particularly when the nozzle is susceptible to cooling therewith. Protection of the nozzle against cooling can keep the melt at a constant temperature and therefore, provide a constant flow rate of the melt discharged from the nozzle, ensuring the manufacture of a permanent magnet material which is homogeneous in a longitudinal direction and has least difference in properties between lots.

The location of the wind shield relative to the nozzle is not particularly limited and the wind shield may be located at a suitable position, depending on the dimensions and circumferential speed of the chill roll, for effectively preventing gas flow entrainment. Preferably the wind shield is spaced from the nozzle center a distance of 150 mm or less, especially 70 mm or less as measured along the chill roll circumference.

The wind shield may be formed of any desired material. It may be suitably selected from various metals and resins as long as it can shield gas flow.

In the practice of the invention, suction means may be provided in proximity to the circumference of chill roll 13 between wind shield 2 and paddle 113. The suction means is effective for sucking the ambient gas in proximity to the paddle to establish a local vacuum thereat, thereby further reducing the amount of ambient gas entrained between the alloy melt and the chill roll circumference.

Figure 4:
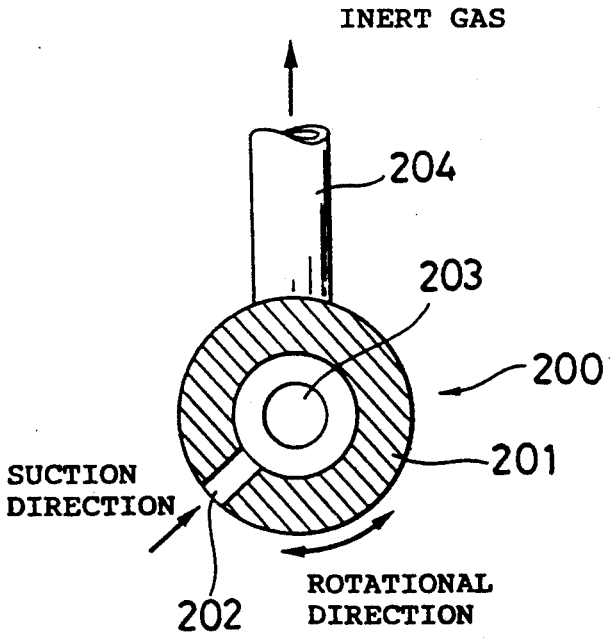
FIG. 4 is a cross sectional view of an exemplary inert gas suction member used in the present invention.

No particular limit is imposed on the construction of suction means. Preferred is one with a slit-shaped suction port having a longitudinal direction aligned with a transverse direction of the chill roll circumference. An exemplary preferred suction means is shown in FIGS. 3 and 4 as a suction member 200. The suction member 200 shown in FIG. 4 has a cylindrical peripheral wall 201 and a slit-shaped suction port 202 extending throughout the wall 201. The slit-shaped suction port 202 has a longitudinal direction extending substantially parallel to the axis of the suction member, i.e., cylindrical peripheral wall 201. One end of the cylindrical peripheral wall 201 (on the front plane of the sheet in the illustrated embodiment) is closed and the other end is connected to a gas outlet tube 204 in flow communication with the suction member interior through a hole 203. The other end of the gas outlet tube 204 is connected to a pump (not shown). With the pump actuated, the ambient gas is taken in through slit-shaped suction port 202 so that a vacuum is established in proximity to suction port 202.

The suction member 200 is disposed in proximity to the chill roll such that the axis of suction member 200 is substantially parallel to the axis of the chill roll. By rotating the suction member 200 about its axis, or by changing the position of suction member 200 relative to paddle 113, or by changing the amount of ambient gas taken in, the degree of vacuum in proximity to the paddle can be controlled as desired.

Since the action of suction means varies with the shape and dimensions of suction port, suction quantity per unit time and other factors, the position of the slit-shaped suction port is not particularly limited and may be empirically determined so as to achieve the desired result. Preferably, the distance between the suction port and the nozzle is about 5 to about 70 mm as measured along the chill roll circumference and the distance between the suction port and the chill roll circumference is about 0.1 to about 15 mm.

Understandably, the configuration of the wind shield and suction means may be empirically determined based on the analysis of the irregularities and grain diameter on the roll surface of the permanent magnet material produced therewith. The remaining components in the embodiment of FIG. 3, for example, injector 101 and chill roll 13 are the same as in FIG. 1.

According to the present invention, there is obtained a permanent magnet material which preferably has only a primary phase of substantially tetragonal grain structure or such a primary phase and an amorphous and/or crystalline auxiliary phase.

Since a stable tetragonal compound of R-T-B system wherein T is Fe and/or Co is $R_2T_{14}B$ wherein R = 11.76 at %, T = 82.36 at % and B = 5.88 at %, the primary phase consists essentially of this compound. The auxiliary phase is present as a grain boundary layer around the primary phase. The permanent magnet material produced according to the invention may be subject to heat treatment for further performance improvement.

The composition of the alloy melt used herein is not particularly limited as long as it comprises R wherein R is at least one element selected from the rare earth elements inclusive of Y, Fe or Fe and Co, and B. The benefits of the invention are achieved with any desired composition although better results including the manufacture of permanent magnets having excellent magnetic properties are obtained from the following composition.

Preferred is a composition containing

Preferred is a composition containing
5 to 20 at % of R,
2 to 15 at % of B,
0 to 55 at % of Co, and
the balance being essentially Fe.
More preferred is a composition containing
5 to 17 at % of R,
2 to 12 at % of B,
0 to 40 at % of Co, and
the balance being essentially Fe.

Further description is made of R. R is at least one element selected from the rare earth elements inclusive of Y, and inclusion of Nd and/or Pr as R is preferred for higher magnetic properties. The content of Nd and/or Pr is preferably at least 60% of the entire amount of R.

In addition to the above-mentioned elements, it is preferred to include at least one element selected from the group consisting of Zr, Nb, Mo, Hf, Ta, W, Ti, V, and Cr as an additive element. These elements are effective for controlling crystal growth. And the benefits of the present invention are achieved more effectively by the addition of these elements. These elements are also effective for improving the amenability of the material to plastic working.

The total content of these additive elements is preferably up to 15 at % of the entire composition. Further, inclusion of Ni is preferred for improving corrosion resistance. The content of Ni is preferably up to 30 at % combined with the additive elements.

Part of B may be replaced by at least one element selected from C, N, Si, P, Ga, Ge, S, and 0. The amount of replacing element is up to 50% of B.

The composition may be readily determined by atomic-absorption spectroscopy, fluorescent X-ray spectroscopy, gas analysis or the like.

EXAMPLE

Examples of the present invention are given below by way of illustration.

EXAMPLE 1

Chill rolls were manufactured by preparing a cylindrical base of copper-beryllium alloy having a diameter of 500 mm and a breadth of 60 mm and applying a Cr surface layer of varying thickness to the circumference of the base by electrolytic plating. The base had a heat conductivity of 3.6 J/(cm-s-K) and the surface layer had a heat conductivity of 0.43 J/(cm-s-K).

Using these chill rolls, permanent magnet material samples were produced in accordance with the following procedure as reported in Table 1. The surface layer of each chill roll used had the thickness shown in Table 1.

First, an alloy ingot having the composition: 9.5Nd-2.5Zr-8B-80Fe as expressed in atomic percentage was prepared by arc melting. The alloy ingot was placed in a quartz nozzle where it was melted by radio frequency induction heating.

The melt was rapidly quenched by a single roll process using each of the chill rolls, obtaining permanent magnet material samples. The ambient pressure during rapid quenching was 200 Torr.

The resulting permanent magnet material samples were in thin ribbon form and had a thickness of 30 to 40 μm.

The spacing between the nozzle tip and the chill roll surface was 0.5 mm, the melt injection pressure was 1 kg/cm$^2$, and Ar gas was used for pressurization. The circumferential speed of the chill roll was selected in the range of from 20 to 35 m/s.

The resulting ribbons were sectioned in such a direction that a readily observable section was obtained. Using a scanning electron microscope, the average grain diameter d in a region of the ribbon extending from the free surface to a depth of 1/5 of the ribbon thickness and the average grain diameter p in a region of the ribbon extending from the roll surface to a depth of 1/5 of the ribbon thickness were determined, and d/p was calculated therefrom. The results are shown in Table 1.

Further, the samples were measured for (BH)max, with the results shown in Table 1.

Each sample had a Cr content of 100 ppm in a region extending up to 20 nm from the roll surface.

TABLE 1

| Sample No. | Surface layer thickness, μm | d/p | (BH) max, MGOe |
|---|---|---|---|
| 1 | 40 | 2.4 | 17 |
| 2 | 80 | 4.0 | 16 |
| 3 | 0.1 | 12 | 14 |

The effectiveness of the invention is evident from the data shown in Table 1.

In examples using chill rolls having the surface layer which was formed by an electroless plated Ni film, sprayed Co film, shrinkage fitted V sleeve, and bonded Nb thin sheet instead of the Cr surface layer, a reduction in d/p in relation to the surface layer thickness was recognized as in the case of the Cr surface layer. The permanent magnet materials were found to contain 10 to 500 ppm of a surface layer-forming element in a region extending up to 20 nm from the roll surface.

Additionally, permanent magnet materials were prepared by a twin roll process in accordance with the above-mentioned Example, observing equivalent results to the Example.

For sample Nos. 1 and 2, permanent magnet materials were prepared using a chill roll whose surface layer had a centerline average roughness Ra of 0.07 to 3.0 μm. It was found that high coercive force was available over a substantially expanded range of circumferential speed, with a 10–20% reduction of d/p and a 10–20% improvement of magnetic properties.

Also for sample Nos. 1 and 2, quenching was effected under an ambient pressure of up to 1 Torr, finding that the samples on the roll surface were free of low-frequency irregularities caused by the entrainment of Ar gas. The standard deviation of average grain diameter in region P was less than 7 nm, with an about 10% improvement of magnetic properties.

Also for sample Nos. 1 and 2, Ar gas was blown against the melt 111 toward the circumference of chill roll 13 as shown in FIG. 1 during quenching of the alloy melt. The direction of blowing gas defined an angle of 120° with the direction of advance of a thin ribbon-shaped permanent magnet material resulting from quenching, and the gas was injected under a pressure of 2 kg/cm$^2$. The distance between the end of the Ar gas flow impinging on the melt nearer to the nozzle and the position of the chill roll circumference just beneath the nozzle was 6 times the nozzle diameter. An injector as shown in FIG. 2 was used for Ar gas blowing.

This resulted in an about 10% reduction of d/p and an improvement of magnetic properties. Auger analysis of the resulting permanent magnet materials showed an Ar content of 200 ppm in a region extending up to 50 nm from the free surface and 30 ppm in a region extending up to 50 nm from the roll surface.

EXAMPLE 2

A chill roll was manufactured by applying a Cr surface layer of 50 μm thick to the circumference of a cylindrical base of copper-beryllium alloy by electrolytic plating. The base had a heat conductivity of 3.6 J/(cm-s-K) and the surface layer had a heat conductivity of 0.43 J/(cm-s-K). Using this chill roll, a permanent magnet material sample was produced in accordance with the following procedure.

First, an alloy ingot having the composition: 9.4Nd-2.6Zr-8B-80Fe as expressed in atomic percentage was prepared by arc melting. The alloy ingot was placed in a quartz nozzle where it was melted by radio frequency induction heating.

The melt was rapidly quenched by a single roll process using the above-mentioned chill roll, obtaining a permanent magnet material designated sample No. 11. Rapid quenching was effected in an Ar gas atmosphere of atmospheric pressure.

The single roll process used a wind shield 2 as shown in FIG. 3. The wind shield was a Cu thin plate fixedly secured relative to the nozzle. The chill roll base had a diameter of 500 mm and a breadth of 60 mm, and the wind shield had a breadth of 80 mm and a thickness of 0.5 mm and included a bent segment at the lower end having a length of 5 mm. The wind shield was spaced 1 mm from the chill roll circumference, and the lower end of the wind shield was spaced 20 mm from the center axis of the nozzle. The spacing between the nozzle tip and the chill roll circumference was 0.5 mm, the melt injection pressure was 1 kg/cm$^2$, and Ar gas was used for pressurization. The chill roll had a circumferential speed of 20 m/s.

The resulting sample No. 11 was in thin ribbon form of 2 mm wide and 45 μm thick. The sample was sectioned in such a direction that a readily observable section was obtained. Using a scanning electron microscope, the average grain diameter d in a region of the ribbon extending from the free surface to a depth of 1/5 of the ribbon thickness and the average grain diameter p in a region of the ribbon extending from the roll surface to a depth of 1/5 of the ribbon thickness were determined, and d/p was calculated therefrom, finding d/p=3. Further measurement of sample No. 11 showed a (BH)max of 17.5 MGOe. Sample No. 11 had a Cr content of 100 ppm in a region extending up to 20 nm from the roll surface.

Additionally, sample No. 12 was prepared by the same procedure as sample No. 11 except that a suction member 200 as constructed in FIGS. 1 and 2 was placed between the nozzle 12 and the wind shield 2 as shown in FIG. 3. The suction member 200 included a slit-shaped suction port 202 having a length of 5 mm and a width of 0.5 mm. The slit-shaped suction port 202 was located at a center-to-center spacing of 10 mm from nozzle 12 and at a height of 2 mm from the chill roll circumference. The suction member was connected to a rotary pump which was operated at a suction rate of 50 l/min. Sample No. 12 showed d/p=2.5 and (BH)max=18.0 MGOe.

Also, sample No. 13 was prepared by the same procedure as sample No. 11 except that the wind shield was omitted. Sample No. 13 showed d/p=10 and (BH)max=15.5 MGOe.

A comparison of these samples showed that sample Nos. 11 and 12 were free of low-frequency irregularities caused by the entrainment of Ar gas, which were found on the roll surface of Sample No. 13. The standard deviation of average grain diameter in region P was 15 nm for sample No. 13, but less than 10 nm for sample Nos. 1 and 2 with a noticeable improvement of magnetic properties.

Figure 5:
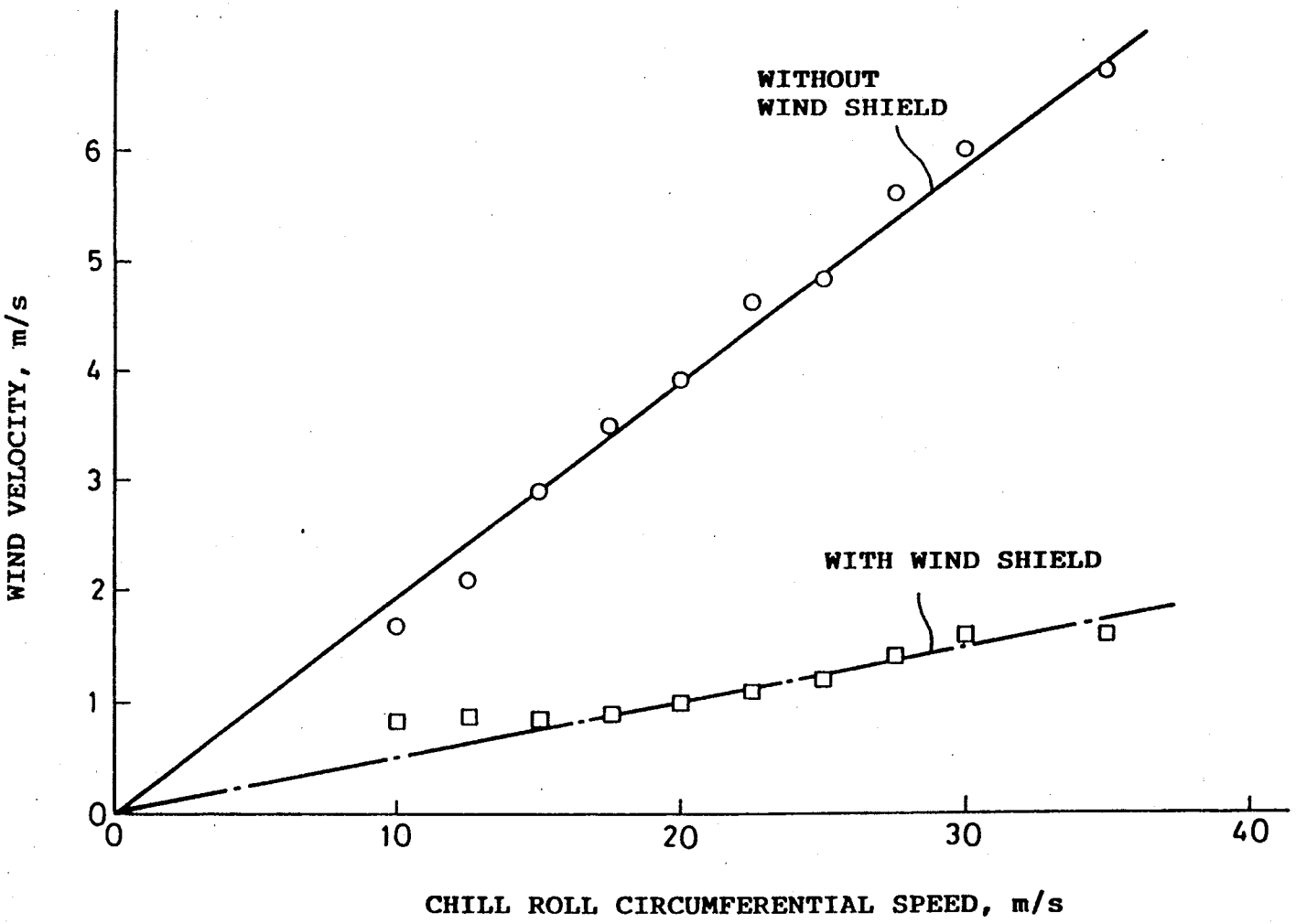
FIG. 5 is a graph showing the circumferential speed of a chill roll versus the velocity of gas wind induced by rotation of the chill roll.

The velocity of gas wind was measured at the position of the nozzle both in the presence and absence of the wind shield. The wind velocity measurement was at a height of 5 mm above the chill roll circumference. FIG. 5 shows the circumferential speed of the chill roll versus the velocity of gas wind. As is evident from FIG. 5, the wind shield was effective for shielding the gas wind.

In examples using chill rolls having the surface layer which was formed by an electroless plated Ni film, sprayed Co film, shrinkage fitted V sleeve, and bonded Nb thin sheet instead of the Cr surface layer, a reduction in d/p in relation to the surface layer thickness was recognized as in the case of the Cr surface layer. The permanent magnet materials were found to contain 10 to 500 ppm of a surface layer-forming element in a region extending up to 20 nm from the roll surface.

Additionally, for each of the above-mentioned runs, permanent magnet materials were prepared using a chill roll whose surface layer had a centerline average roughness Ra of 0.07 to 5 μm. It was found that high coercive force was available over a substantially expanded range of circumferential speed, with a reduction of d/p and an improvement of magnetic properties.

Also, Ar gas was blown against the melt 111 toward the circumference of chill roll 13 as shown in FIG. 3 during quenching of the alloy melt. The direction of blowing gas defined an angle of 120° with the direction of advance of a thin ribbon-shaped permanent magnet material resulting from quenching, and the gas was injected under a pressure of 2 kg/cm$^2$. The distance between the end of the Ar gas flow impinging on the melt nearer to the nozzle and the position of the chill roll circumference just beneath the nozzle was 6 times the nozzle diameter. An injector as shown in FIG. 2 was used for Ar gas blowing. This resulted in a further reduction of d/p and an improvement of magnetic properties. Auger analysis of the resulting permanent magnet materials showed an Ar content of 200 ppm in a region extending up to 50 nm from the free surface and 30 ppm in a region extending up to 50 nm from the roll surface.

BENEFITS OF THE INVENTION

According to the present invention, there are obtained permanent magnet materials having uniform grain diameter. The present invention is thus quite suited for the manufacture of permanent magnet materials for bonded magnets.

We claim:

1. A permanent magnet material prepared by melting an alloy composition comprising R which is at least one rare earth element including Y, Fe or Fe and Co, and B, and contacting the melt with at least one chill roll on the melt surface, thereby quenching the melt from one direction or two opposite directions, wherein the permanent magnet material has a surface in contact with said at least one chill roll, a region D disposed remotest from the surface in contact with said chill roll in a thickness direction, and a region P disposed adjacent the surface in contact with said chill roll, and said region D has an average grain diameter d and said region P has an average grain diameter p wherein $d/p \leqq 10$ and, wherein the permanent magnetic material has a surface in contact with said chill roll, said surface having a center line average roughness Ra of 0.05 to 4.5 μm.

2. The permanent magnet material of claim 1 wherein $1 \leqq d/p \leqq 4$.

3. The permanent magnet material of claim 1 or 2 wherein said average grain diameter d ranges from 0.01 to 2 pm and said average grain diameter p ranges from 0.005 to 1 μm.

4. The permanent magnet material of claim 1 or 2 wherein the melt is quenched from one direction, and the permanent magnet material has a thickness of up to 60 μm in a direction normal to the surface in contact with said chill roll.

5. The permanent magnet material of claim 1 or 2 wherein the melt is quenched from two opposite directions, and the permanent magnet material has a thickness of up to 120 μm in a direction normal to the surface in contact with said chill roll.

6. The permanent magnet material of claim 1 or 2 wherein said region disposed adjacent the surface in contact with said chill roll contains an element of which said chill roll at its surface is comprised.

7. The permanent magnet material of claim 6 wherein said element is at least one member selected from the group consisting of Co, Ni, Cr, V, and Nb.

8. The permanent magnet material of claim 1 or 2 wherein the melt is quenched from one direction, and said region D has a higher content of inert gas than said region P.

9. The permanent magnet material of claim 1 or 2 having a composition comprising 5 to 20 atom % of R, 2 to 15 atom % of B, 0 to 55 atom % of Co, and up to 15 atom % of at least one element selected from the group consisting of Zr, Nb, Mo, Hf, Ta, W, Ti, V, and Cr.

10. A permanent magnet material prepared by melting an alloy composition comprising R which is at least one rare earth element including Y, Fe or Fe and Co, and B, and contacting the melt with at least one chill roll on the melt surface, thereby quenching the melt from one direction or two opposite directions, wherein the permanent magnet material has a surface in contact with said chill roll, said surface having a centerline average roughness Ra of 0.05 to 4.5 μm.

11. The permanent magnet material of claim 10 wherein the melt is quenched from one direction, and the permanent magnet material has a thickness of up to 60 μm in a direction normal to the surface in contact with said chill roll.

12. The permanent magnet material of claim 10 wherein the melt is quenched from two opposite directions, and the permanent magnet material has a thickness of up to 120 μm in a direction normal to the surface in contact with said chill roll.

13. The permanent magnet material of any one of claim 10 to 12 wherein the surface in contact with said chill roll has a centerline average roughness Ra which is not higher than the centerline average roughness Ra of said chill roll on its surface.

14. The permanent magnet material of any one of claims 10 to 12 wherein as region disposed adjacent the surface in contact with said chill roll contains an element of which said chill roll at its surface is comprised.

15. The permanent magnet material of claim 14 wherein said element is at least one member selected from the group consisting of Co, Ni, Cr, V, and Nb.

16. The permanent magnet material of any one of claims 10 to 12 having a composition comprising 5 to 20 atom % of R, 2 to 15 atom % of B, 0 to 55 atom % of Co, and up to 15 atom % of at least one element selected form the group consisting of Zr, Nb, Mo, Hf, Ta, W, Ti, V, and Cr.

* * * * *

UNITED STATES PATENT AND TRADEMARK OFFICE

CERTIFICATE OF CORRECTION

PATENT NO. : 5,209,789

DATED : May 11, 1993

INVENTOR(S) : YONEYAMA et al.

It is certified that error appears in the above-identified patent and that said Letters Patent is hereby corrected as shown below:

Column 24, line 29, delete "as" and insert therefore --a--.

Signed and Sealed this

Twenty-eighth Day of June, 1994

*Attest:*

Bruce Lehman

BRUCE LEHMAN

*Attesting Officer*

*Commissioner of Patents and Trademarks*